US006428646B1

(12) United States Patent
Jim et al.

(10) Patent No.: US 6,428,646 B1
(45) Date of Patent: Aug. 6, 2002

(54) METHOD AND APPARATUS FOR APPLICATION OF ADHESIVE TAPE TO AN ELONGATED MEMBER

(75) Inventors: Gordon W. Jim, Noble; Dennis Johnson; Duc T. Tran, both of Oklahoma City, all of OK (US)

(73) Assignee: Xerox Corporation, Stamford, CT (US)

( * ) Notice: Subject to any disclaimer, the term of this patent is extended or adjusted under 35 U.S.C. 154(b) by 75 days.

(21) Appl. No.: 09/604,787

(22) Filed: Jun. 28, 2000

(51) Int. Cl.[7] ..... B31F 7/00; B31C 11/00; G05G 15/00; B65H 49/18; B65H 19/28

(52) U.S. Cl. ..... 156/183; 156/185; 156/250; 156/506; 156/522; 156/157; 156/350; 242/550; 242/556; 242/556.1; 242/555

(58) Field of Search ..... 156/304.1, 157, 156/304.3, 504, 505, 506, 517, 250, 230, 206, 350, 353, 361, 494, 495, 510, 523, 540, 543, 553, 199, 502, 446, 522, 183, 185; 242/173, 550, 555.3, 554.2, 555, 556.1, 551, 553

(56) References Cited

U.S. PATENT DOCUMENTS

| | | | | | |
|---|---|---|---|---|---|
| 4,295,916 | A | * | 10/1981 | Stevens | 156/397 |
| 4,321,103 | A | * | 3/1982 | Lindstrom et al. | 156/351 |
| 4,385,959 | A | * | 5/1983 | Goguen | 156/506 |
| 4,591,402 | A | * | 5/1986 | Evans et al. | 156/350 |
| 4,980,011 | A | * | 12/1990 | Gruber et al. | 156/361 |
| 5,431,767 | A | * | 7/1995 | Koza et al. | 156/350 |

* cited by examiner

*Primary Examiner*—J. A. Lorengo
(74) *Attorney, Agent, or Firm*—Oliff & Berridge, PLC

(57) ABSTRACT

An apparatus and method for applying adhesive transfer tape, including an adhesive tape transfer roll holding an adhesive transfer tape, a roll locking cylinder wherein the roll locking cylinder stops the adhesive tape transfer roll from rolling, stopping the transfer of the adhesive transfer tape, and where the locking cylinder further holds the adhesive transfer tape roll for a predetermined time after the completion of the tape transfer such that internal stresses are dissipated. The apparatus and method may further include a piston that raises the adhesive transfer tape at the same time as the roll locking cylinder stops the adhesive tape transfer roll stops rolling.

7 Claims, 6 Drawing Sheets

METHOD AND APPARATUS FOR APPLICATION OF ADHESIVE TAPE TO AN ELONGATED MEMBER

BACKGROUND OF THE INVENTION

1. Field of Invention

This invention is directed to applying adhesive tape to an elongated member.

2. Description of Related Art

Elongated members of various materials, such as webs and the like, are produced in bulk and wound on large spools for efficiency during transport. The large spools need to be sectioned into smaller spools for various end uses. When respooling elongated members, adhesive needs to be applied to the beginning and end sections of each portion of the elongated member. The beginning section adhesively attaches the portion of the elongated member to the spool. The end section keeps the portion of the elongated member wound on the spool from unwinding from the spool.

One method of applying adhesive is to form an adhesive transfer tape on a roll. The adhesive transfer tape roll then contacts the elongated member to apply the adhesive transfer tape to specific sections of a portion of the elongated member. The adhesive transfer tape applied to the elongated member is separated from the roll of adhesive transfer tape by tearing the adhesive transfer tape by moving the adhesive transfer tape roll and the elongated member relatively away from each other.

SUMMARY OF THE INVENTION

Known respooling machines have difficulty with accurately applying the adhesive transfer tape and ending the adhesive transfer tape transfer. Known adhesive transfer tape applicators, such as Dynak model #9E1590, do not efficiently transfer the adhesive transfer tape to the elongated member.

For example, on conventional respooling machines, applying the adhesive transfer tape to the elongated member is controlled by a cam rolling along a cam track. The cam track and cam assembly allow the adhesive tape roll to rotate to apply the adhesive tape and locks the adhesive tape roll to stop applying the adhesive tape. The cam track, for example, has two levels and has transitions between the two levels that respectively engage and disengage the roll locking piston. The adhesive tape transfer roll slides along the elongated member between tape applications. The conventional respooling machines do not efficiently control the tape transfer process, causing the adhesive transfer tape to break in the wrong place or to become dislodged from the elongated member.

This invention provides tape transfer systems and methods that lift the adhesive tape transfer roll to a breaking position after applying the adhesive transfer tape to the elongated member to facilitate the adhesive transfer tape being applied to the elongated member from the adhesive transfer tape roll.

This invention separately provides tape transfer systems and methods that hold the adhesive transfer tape in an application position for a period of time to allow internal stresses to be released prior to moving the adhesive transfer tape back to a start position for the next adhesive transfer tape applying operation. The tape transfer systems and methods of this invention permit, for example, various qualities of adhesive transfer tape to be used. This allows users flexibility and improves cost savings when choosing an adhesive transfer tape.

These and other features and advantages of this invention are described in or are apparent from the following detailed description of various exemplary embodiments of the systems and methods according to this invention.

BRIEF DESCRIPTION OF THE DRAWINGS

Various exemplary embodiments of this invention will be described in detail with reference to the following figures wherein.

DETAILED DESCRIPTION OF PREFERRED EMBODIMENTS

Figure 1:
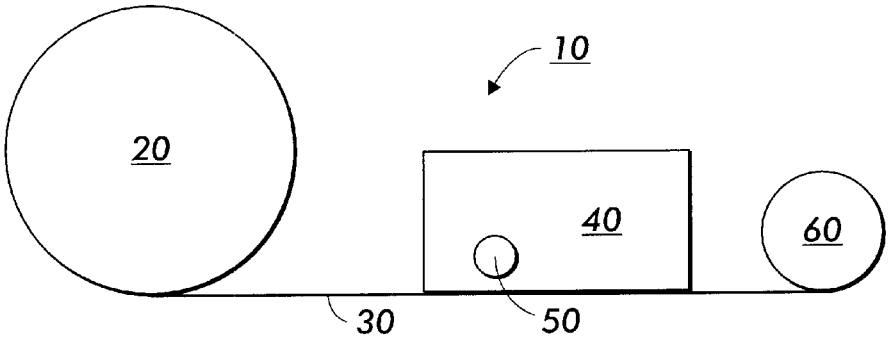
FIG. 1 PRIOR ART
FIG. 1 is a block diagram of A Prior Art embodiment of an elongated member respooling apparatus.

FIG. 1 shows a block diagram of A Prior Art embodiment of an elongated member respooling apparatus 10. The elongated member respooling apparatus 10 includes an initial elongated member roll 20, a final elongated member roll 60 and an elongated member cutter re-feeder 40 with an adhesive tape transfer roll 50. Portions of the elongated member 30 are transferred from the initial elongated member roll 20 to the final elongated member roll 60.

The elongated member cutter re-feed 40 applies adhesive transfer tape from the adhesive tape transfer roll 50 to the elongated member 30 before cutting the current portion of the elongated member 30 from the rest of the elongated member 30 to complete the current final elongated member roll 60 and beginning to feed the next portion of the elongated member 30 to the next elongated member roll 60. The final elongated member roll 60 is regularly replaced as it fills up. The initial elongated member roll 20 is replaced, for example, one-eighth as many times as is the final elongated member roll 60.

The initial elongated member roll 20 is first loaded into the elongated member respooling apparatus 10. A start end of a first portion of the elongated member 30 is withdrawn from the initial elongated member roll 20 and fed through the elongated member cutter re-feeder 40 to respool the first portion of the elongated member 30 from the initial elongated member roll 20 to the final elongated member roll 60. The elongated member cutter re-feeder 40 then applies a first strip of adhesive transfer tape 52 to the beginning section of the first portion of the elongated member 30 using the adhesive tape transfer roll 50.

The elongated member 30 is then fed into the final elongated member roll 60. In particular, the elongated member 30 is advanced until the final elongated member roll 60 is full. The elongated member cutter re-feeder 40 then applies two strips of the adhesive transfer tape 52 and 56 from the adhesive transfer tape roll 50 to the elongated member 30. This is shown in greater detail in FIG. 2. The second strip of the adhesive transfer tape 56 keeps the current portion of the elongated member loaded to the current final elongated member roll 60 from unwinding. Another first strip of the adhesive transfer tape 52 attaches the next portion of the elongated member 30 to the next final elongated member roll 60.

The initial elongated member roll 20, the final elongated member roll 60 and the elongated member 30 are shown as exemplary embodiments. The elongated member can actually be a substrate of any known or later developed material, such as tape, plastic, cloth or paper. Any substances which needs to be transferred from a first roll to a second roll and fastened to the second roll by an adhesive is suitable for use in the present invention.

Further, the Prior Art embodiment shows one initial elongated member roll 20 and a single final elongated member roll 60. However, multiple initial elongated member rolls 20 and multiple final elongated member rolls 60 can be used either in sequence or simultaneously where the elongated member cutter re-feeder 40 also slits or joins the elongated member 30 in the travel direction as well as cutting the elongated member 30 when the final elongated member roll 60 is full.

Figure 2:
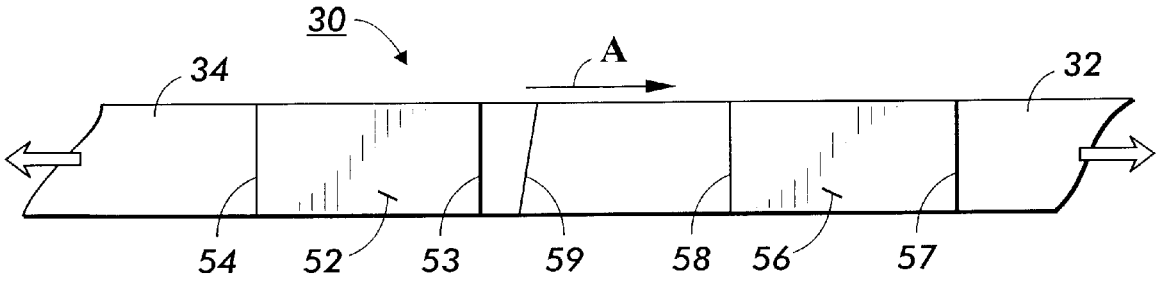
FIG. 2 PRIOR ART
FIG. 2 is a diagram of the section of the Prior Art elongated member that has adhesive transfer tape applied to it.

FIG. 2 shows the elongated member 30 of the Prior Art as it travels through the elongated member cutter re-feeder 40. The portion of the elongated member 30 shown in FIG. 2 includes the second adhesive tape portion or strip 56 which keeps the current portion of the elongated member 30 from unwinding from the current final elongated member roll 60 and the first adhesive tape portion or strip 52 which attaches the elongated member 30 to the final elongated member roll 60.

The first adhesive transfer tape portion is begun at start line 54. The first adhesive tape portion 52 is separated from the second adhesive transfer tape portion 56 by a distance extending between the start line 58 of the second adhesive tape portion 56 and the end line 53 of the first adhesive tape portion 52. That is, the first adhesive tape portion 52 is broken off of the adhesive transfer tape roll 50 at the end line 53 by applying a tensile force between the first adhesive tape portion 52 and the rest of the adhesive transfer tape 50. This tensile force causes the adhesive transfer tape to fracture at the end, or break, at the end line 53.

After the first adhesive tape portion 52 is adhesively attached to the current portion of the elongated member 30 being wound on the current final elongated member roll 60, the second adhesive tape portion 56 is started at the start line 58 and adhesively attached to the beginning section of the next portion 32 of the elongated member 30. The second adhesive tape portion 56 is then broken off from the adhesive transfer tape 50 at the end, or break, line 57 by applying a tensile force between the second adhesive tape portion 56 and the rest of the adhesive transfer tape roll 50. As above, the tensile force causes the adhesive transfer tape 50 to fracture, or break, at the end line 57.

The elongated member 30 travels in the direction of the arrow A. After the first and second adhesive transfer tape portions 52 and 56 have been applied, the elongated member 30 is cut at a cut line 59 to separate the current portion 32 of the elongated member 30 from the next portion 34.

Figure 3:
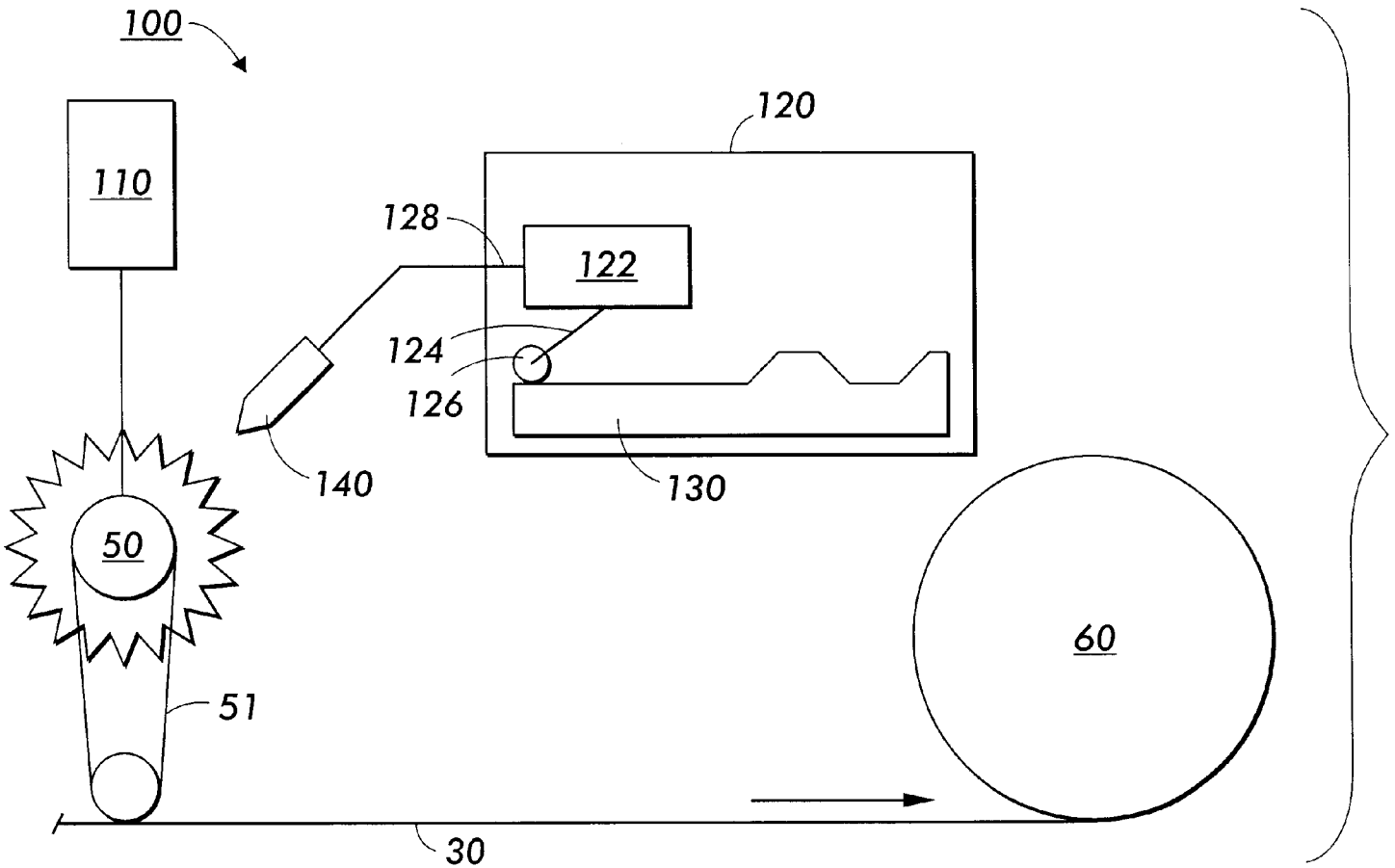
FIG. 3 PRIOR ART
FIG. 3 is a block diagram of one exemplary embodiment of a known respooling apparatus.

FIG. 3 shows a portion of a conventional respooling apparatus 100. As shown in FIG. 3, the conventional elongated member respooling apparatus 100 includes a transfer tape extending apparatus 110, the adhesive tape roll 50, a roll locking apparatus 140 and an adhesive tape application controller 120. The adhesive tape application controller 120 includes a cam track 130 and a switch 122 connected to a cam 126 via a link 124. The cam 126 travels along the cam track 130 to selectively apply the adhesive tape 50 to the elongated member 30.

The roll locking apparatus 140 engages with the adhesive tape roll 50 to prevent the adhesive tape roll 50 from rotating. This prevents the adhesive tape from being applied to elongated member 30. The adhesive tape roll 50 may not directly contact elongated member 30, but may contact elongated member 30 through a roll extender 51. The roll extender 51 can be any apparatus for allowing the adhesive tape roll 50 to contact the elongated member 30 while allowing roll locking apparatus 140 to engage the adhesive tape roll. The tape extending apparatus 110 is not connected to the roll locking apparatus 140 and simply engages the adhesive tape roll 50 at the beginning of the application cycle and disengages the adhesive tape roll 50 at the end of the application cycle.

In the conventional respooling apparatus 100, because the adhesive tape transfer roll 50 quickly lifts upward and retracts as it travels on the cam track 130, the transfer tape does not have enough surface area of the elongated member 30 to stick against. The lack of enough transfer tape on the elongated member 30 and the sudden pulling on the transfer tape as the adhesive tape transfer roll 50 retracts causes the transfer tape to peel from the elongated member 30. Further, the short travel length due to the small notched cam track 130 when the tape extending apparatus 110 is pushing the adhesive tape transfer roll 50 down causes the adhesive tape transfer roll 50 to skid across the elongated member 30. This occurs because too much compression force was exerted by the tape extending apparatus 110, which caused the adhesive transfer tape roll 50 to lock up. This forces the operator to have to reset the elongated member 30 each time the transfer tape peels. This causes considerable down time since large volumes of elongated member 30 are respooled each day.

The switch 122 is connected to the cam 126 via the link 124, such that, when the cam 126 and the cam track 130, move relative to each other the link 128 engages the roll locking apparatus 140 with, or disengages the roll locking apparatus 140 from, the adhesive tape roll 50, as noted below. It should be appreciated that for ease of understanding only, the following description refers to the cam travelling along a stationary cam track, event though, in a working embodiment, the cam track may move relative to a stationary cam.

For example, the elongated member 30 travels towards final roll 60 and fills up the current final elongated member roll 60. When the current final elongated member roll 60 is determined to be full, the tape application is initialed process. The tape application process begins by the roll extending apparatus 110 moving the adhesive tape roll 50 into contact with the elongated member 30.

Figure 4:
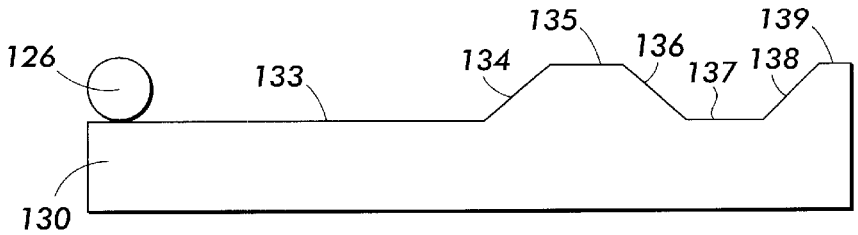
FIG. 4 PRIOR ART
FIG. 4 is a diagram of a conventional cam and cam track.

As shown in Prior Art FIG. 4, at the beginning of the tape application cycle, the cam 126 starts traveling along the first tape application portion 133 of the cam track 130. When the cam 126 reaches the first tape break portion 134 on the cam track 130, the cam 126 moves up. This upward motion is transferred through the physical link 124 to the switch 122. The switch 122 then engages an air power transfer link 128, such that roll locking apparatus 140 engages the adhesive tape roll 50 and stops the adhesive tape roll 50 from rolling and stops adhesive tape roll 50 from applying adhesive tape to the elongated member 30.

The adhesive tape roll 50 may not directly contact the elongated member 30, but may contact the elongated member 30 through the roll extender 51. The roll extender 51 can be any apparatus that allows the adhesive tape roll 50 to contact the elongated member 30 while allowing the roll locking apparatus 140 to engage the adhesive tape roll 50 at a distance from the elongated member 30

The cam 126 then moves along the tape non-application portion 135 that spaces the adhesive tape strip 56 from the adhesive tape strip 52. Then, when the cam 126 reaches the tape release portion 136, at the end of the tape non-application portion 135, the cam 126 disengages the switch 122 via the physical link 124. The switch 122 then cuts off the air supply to the air power transfer link 128, such that the roll locking apparatus 140 disengages from the adhesive tape roll 50. The tape is then applied as the cam 126 travels along a second tape application portion 137 to apply the tape strip 56. The adhesive tape is applied to the elongated member 30 until the cam 126 reaches the second tape break portion 138. At the second tape break portion 138, the cam 126 once again moves up, engaging, via the switch 122, the roll locking apparatus 140 with the adhesive tape transfer roll 50 to stop the adhesive tape transfer roll 50 from rolling. The process ends when the cam 126 reaches the end of the portion 139, signaling that the respooling apparatus 100 should be reset.

However, in the conventional respooling apparatus 100 another problem is created, in that the distance between the second adhesive tape portion 56 and the first adhesive tape portion 52 needs to be free of adhesive. As shown in FIGS. 3 and 4, in the conventional respooling apparatus 100, the roll locking apparatus 140 is used to stop the application of the adhesive tape in the portion of the elongated member 30 corresponding to the second tape non-application portion 135 of the cam track 130. However, engaging the roll locking apparatus 140 at the end of the second adhesive tape portion 56 results in a lack of build-up of stresses within the adhesive tape transfer roll 50, such that the adhesive tape may fail to break, causing a malfunction. The malfunction may take the form of an improperly or not torn adhesive transfer tape or a dislodged adhesive transfer tape roll 50. The respooling apparatus 100 must then be shut down and the adhesive transfer roll 50 reset by hand.

The elongated member cutter/re-feeder 40 has been described in conjunction with the cam track 130. However, any timing means, such as a cable with regular protrusions or a timing circuit, can be used with the respooling apparatus according to this invention.

Figure 5:
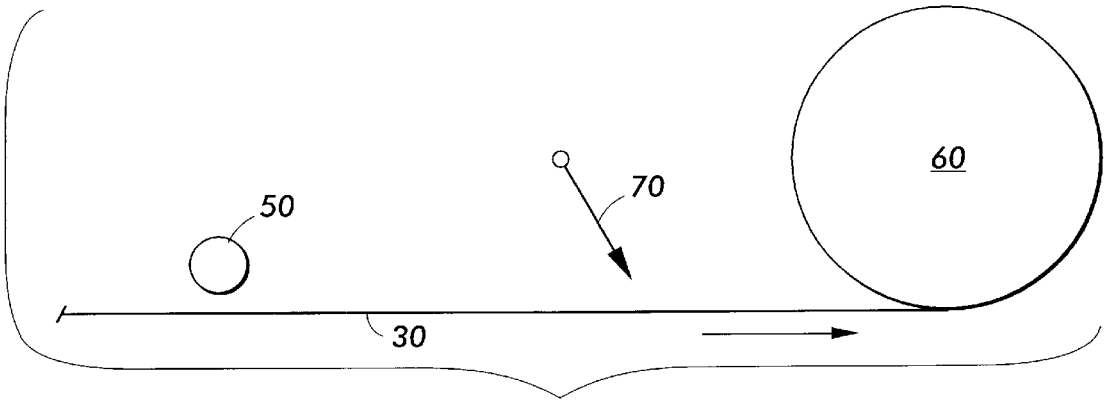
FIGS. 5–8 are diagrams illustrating one exemplary embodiment of the process for applying adhesive transfer tape.

FIGS. 5–8 are diagrams illustrating one exemplary embodiment of the process for applying the adhesive transfer tape. As shown in FIG. 5, the elongated member 30 traveling towards final elongated member roll 60 passes by the adhesive transfer roll 50 and a cutting knife 70. When a determination has been made that the elongated member 30 has filled up the final elongated member roll 60, the tape application process begins.

Figure 6:
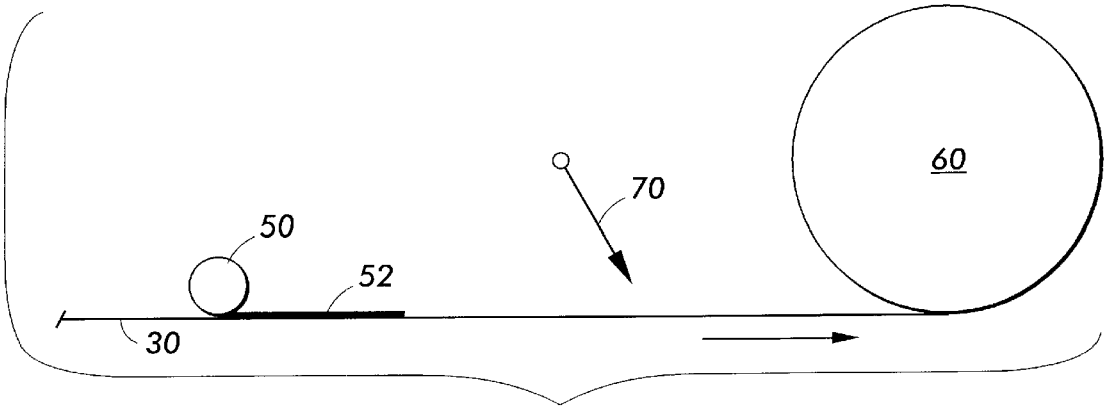

FIG. 6 shows the adhesive transfer tape roll 50 in contact with the elongated member 30 to apply the first adhesive tape portion 52. The first adhesive tape portion 52 is then broken from the adhesive transfer tape roll 50 when the roll locking apparatus 140 engages the adhesive tape transfer roll 50. As a result, the adhesive tape portion 52 is torn from the adhesive tape transfer roll 50.

Figure 7:
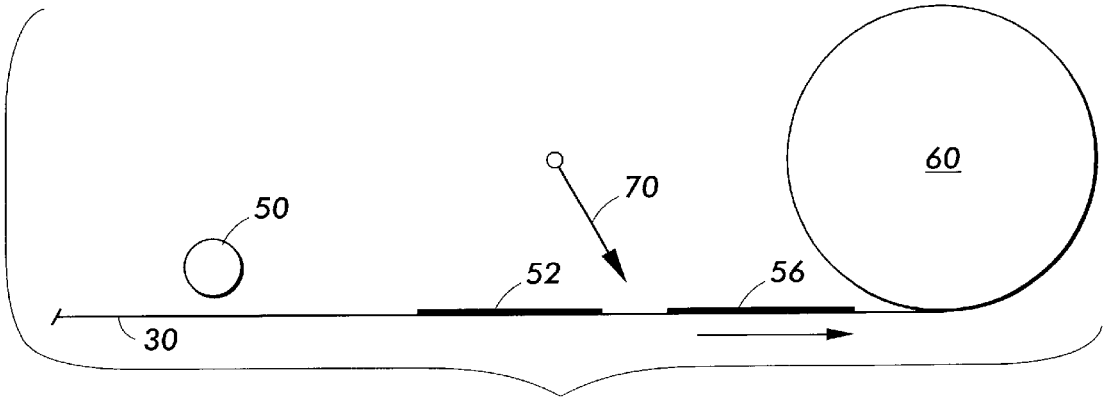

FIG. 7 shows the elongated member 30 with both of the first and second adhesive tape portions 52 and 56 applied to the elongated member 30. Both of the first and second adhesive tape portions 52 and 56 have been broken off from the adhesive tape transfer roll 50 and are moving towards final elongated member roll 60.

Figure 8:
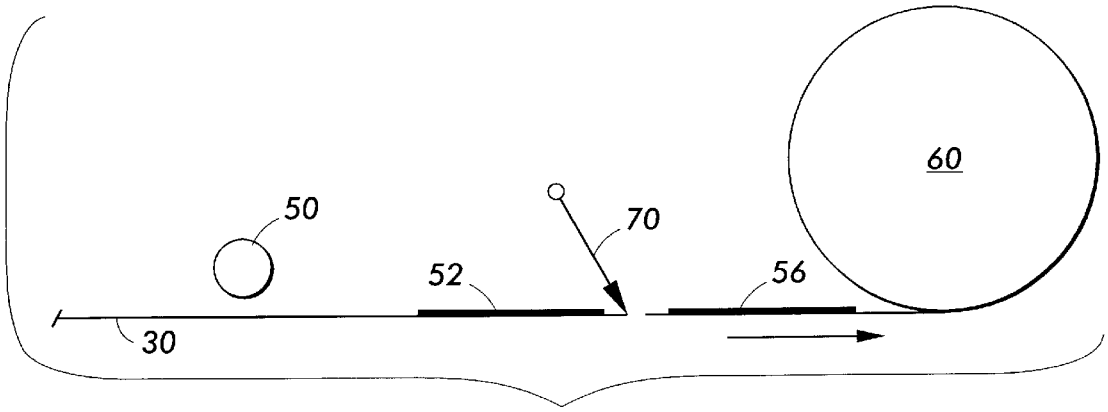

FIG. 8 shows the cutting knife 70 cutting the elongated member 30 between the first and second adhesive tape portions 52 and 56. This ends the adhesive tape transfer process and begins the switch from the current to the next final elongated member roll 60.

When using this conventional respooling apparatus 10, it is difficult to accurately judge where the adhesive tape portions 52 and 56 are going to break off from the adhesive tape transfer roll 50. As the portion 33 of the elongated member 30 between the first and second adhesive tape portions 52 and 56 is small, it is cumbersome and difficult to put any sort of cutting knife (not shown) around the adhesive transfer tape roll 50 to precisely cut the adhesive tape portions 52 and 56 from the adhesive transfer tape roll 50. Thus, this invention identifies two methods to improve the accuracy and efficiency of the breaking point of the adhesive transfer tape 50 through tension breaking.

Figure 9:
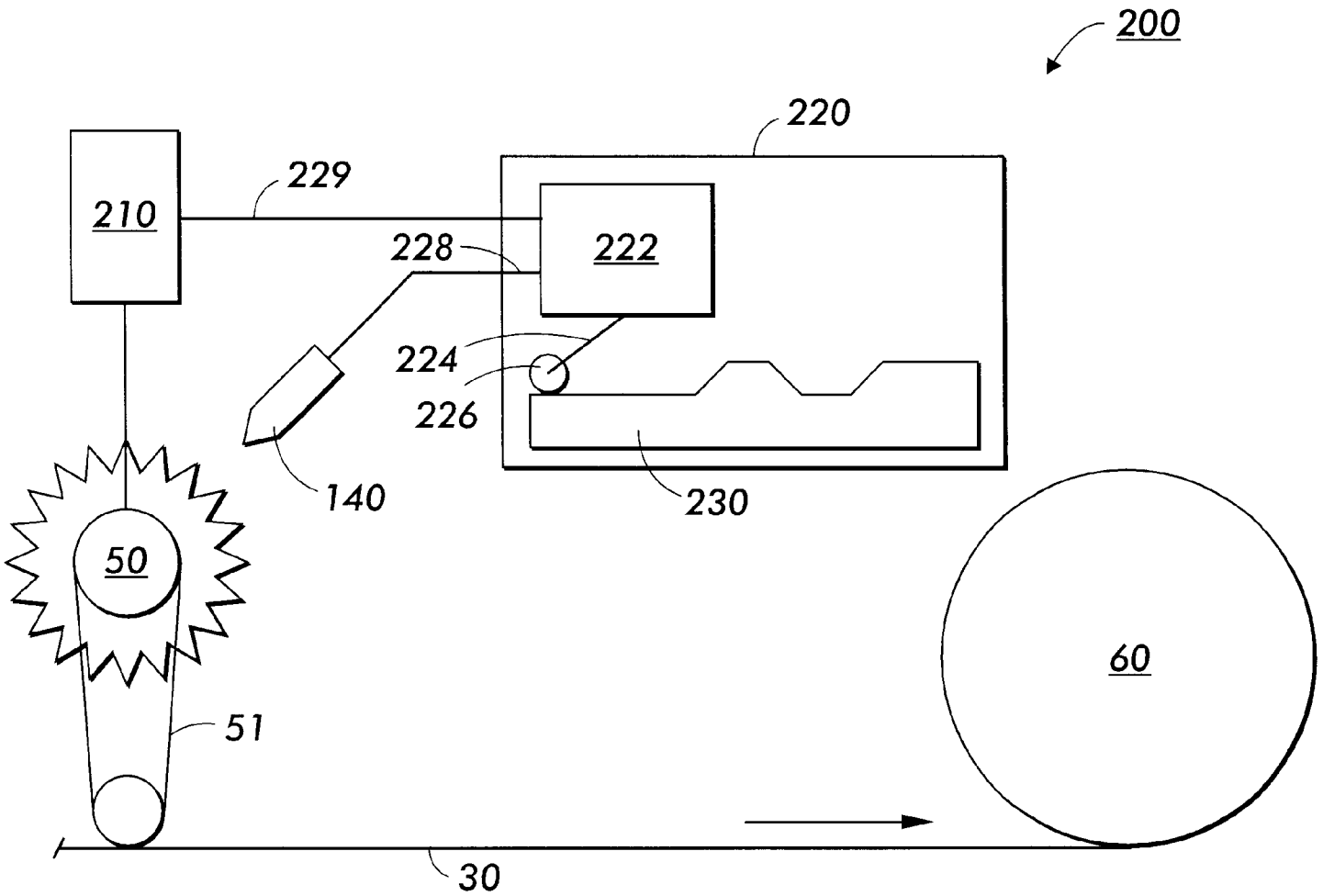
FIG. 9 is a block diagram of one exemplary embodiment of a respooling apparatus according to the invention.

FIG. 9 shows a portion of a respooling apparatus 200 according to this invention. As in FIG. 3, the conventional elongated member respooling apparatus 200 includes a roll extending apparatus 210, the adhesive tape roll 50, the roll locking apparatus 140 and an adhesive tape application controller 220. The adhesive tape application controller 220 includes an improved cam track 230 and or an improved switch 222 connected to a cam 226 via a link 224. The cam 226 travels along the cam track 230 to selectively apply the adhesive transfer tape roll 50 to the elongated member 30.

The roll locking apparatus 140 engages with the adhesive tape transfer roll 50 to prevent the adhesive tape transfer roll 50 from rotating. This prevents the adhesive tape from being applied to the elongated member 30. The roll extending apparatus 210 is connected to the roll locking apparatus 140 through the links 229 and 228 and the switch 222. The roll extending apparatus 210 engages the adhesive tape transfer roll 50 at the beginning and end of the application cycle. In contrast to the conventional respooling apparatus 100, the respooling apparatus 200 also moves the adhesive tape roll 50 to a cutting position at the same time the roll locking apparatus 140 engages and disengages the adhesive tape roll 50 at the end of each application of the first and second tape strips 52 and 56.

The switch 222 is connected to the cam 226 via the link 224 and to the roll extending apparatus 210 via the link 229 such that when the cam 226 travels along the cam track 230, the link 228 engages or disengages the roll locking apparatus 140 and link 229 engages or disengages the roll extending apparatus 210.

For example, as the elongated member 30 traveling towards the current final roll 60 and fills up the current final elongated member roll 60 and initiates the tape application process. The tape application process begins by the roll extending apparatus 210 moving the adhesive tape transfer roll 50 into contact with the elongated member 30.

Figure 10:
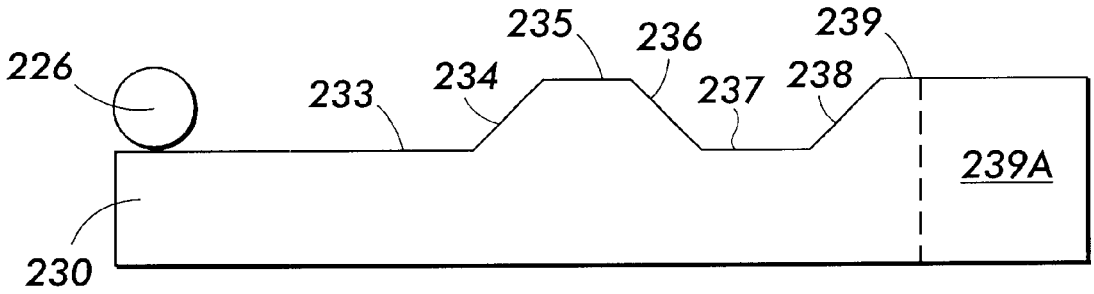
FIG. 10 is a diagram of one exemplary embodiment of a cam and cam track of the respooling apparatus shown in FIG. 9.

As shown in FIG. 10, at the beginning of the tape application cycle, the cam 226 starts traveling along the first tape application portion 233 of the cam track 230. When the cam 226 reaches the first tape break portion 234, at the end of the first tape application portion 233 of the cam track 230, the cam 226 moves up. This upward motion is transferred through the physical link 224 to the switch 222. The switch 222 then engages the air power transfer links 228 and 229 such that roll locking apparatus 140 engages the adhesive tape transfer roll 50 and stops the adhesive tape transfer roll 50 from rolling, while at the same time, the tape extending apparatus 210 lifts the adhesive tape transfer roll 50 from contact with the elongated member 30.

Then, when the cam 226 reaches the tape release portion 236, the cam 226 disengages the switch 222 via the physical link 224. The switch 222 then cuts off the air supply to the air power transfer links 228 and 229, such that the roll locking apparatus 140 disengages from the adhesive tape roll 50, while the tape extending apparatus 210 places the adhesive tape transfer roll 50 back into contact with the elongated member 30. The tape is then applied as the cam 226 travels along the second tape application portion 237 until the cam 226 reaches the second tape break portion 238.

At the second tape break portion 238, the cam 226 once again moves up, engages via the switch 222, causing the roll locking apparatus 140 to stop the adhesive tape transfer roll 50 and the tape extending apparatus 210 to lift the adhesive tape transfer roll 50 from the elongated member 30. The cam 226 then travels along a second tape non-application portion 239, including an extended portion 239*a*, until all internal stresses in the adhesive tape transfer roll 50 have equalized. The process ends when the cam 226 reaches the end of the second portion 239*a*, signaling that the respooling apparatus 200 should be reset.

Figure 11:
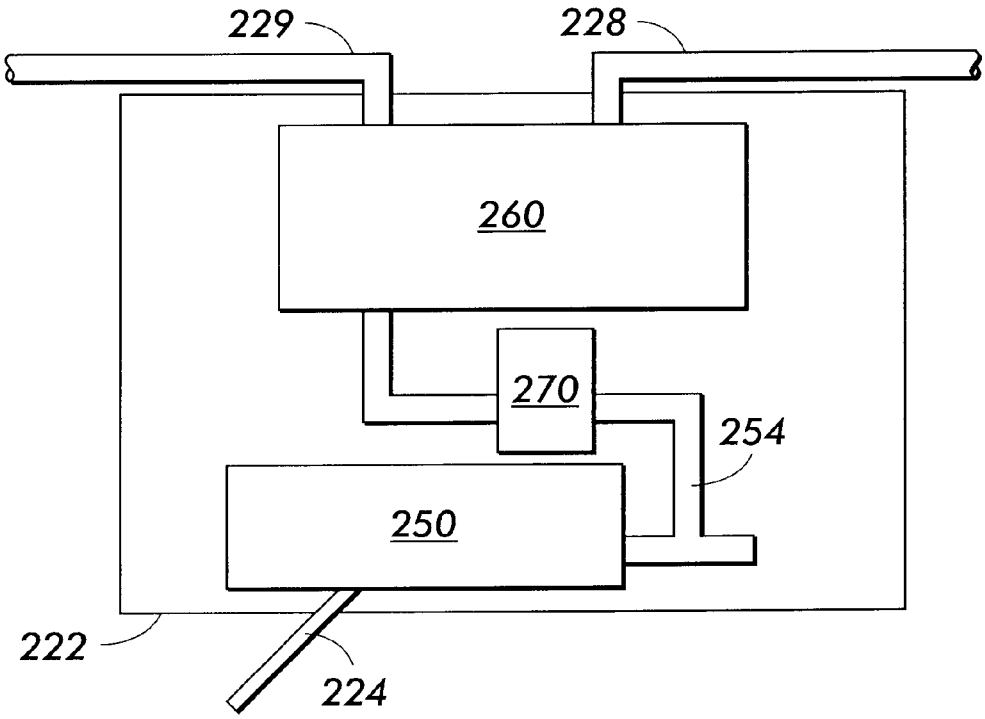
FIG. 11 is a diagram showing the switch 222 of FIG. 9 in greater detail.

FIG. 11 shows one exemplary embodiment of the switch 222 in greater detail. As shown in FIG. 11, the switch 222 includes a switch element 250, an air dispersion device 260, a common vent 270, and air pressure transfer links 254, 229 and 228. The switch 222 is controlled through the physical link 224 which is attached to the switch element 250.

As noted above, when the cam 226 moves downward, the movement is communicated through the physical link 224. The link 224 controls the switch element 250 to remove the air force from the air pressure transfer links 229 and 228. The switch element 250 can be the known device part number ARO 202C. The switch 250 removes the power from the air pressure transfer links 229 and 229 by removing the pressure from the air pressure transfer link 254. The air pressure transfer link 254 is connected to the air dispersion device 260. The air dispersion device 260 can be the known device part number ARO 5030-07 that includes one input port and two output ports.

When the switch 250 and the air dispersion device 260 remove the air pressure from the air pressure transfer links 254, 229, and 228 the air may be released through the common vent 270.

While air pressure transfer links 128, 228, 229 and 254 are discussed in terms of air power supply systems, other combinations are possible. For example, air pressure transfer links 128, 228, 229 and 254 can be physical, hydraulic or electrical links. In addition, physical link 124 can be an electrical, hydraulic, wireless or air pressure link. In general, the links described herein can be any known or later developed connection system or structure for connecting the described components.

Thus this exemplary embodiment increases the amount of surface area the transfer tape comes into contact with as it begins to break from the elongated member 30. In this embodiment, the cam track 230 was modified at the end of its travel length 238. This allows the adhesive transfer tape roll 50 to travel over a longer distance as it is lifting to break the transfer tape so that more tearing force is applied.

In another exemplary embodiment, to have more of a pulling upward force applied to the elongated member 30, a 3-way spool valve was inserted below the air cylinder to control the amount of air going to the air cylinder as the switch 222. A roll contact switch was used as the switch element 250 to come in contact with the cam 223 to control when air would be applied to the tape extending apparatus 210. When the cam 223 was rolling along the lower notched level of the cam track 230, the cam 223 caused the spool valve to release air from the tape extending apparatus 210 which caused the spring above the tape extending apparatus 210 to force the tape extending apparatus 210 down. Using a double notched cam track 230 allows for the adhesive tape transfer roll 50 to lower onto the elongated member twice so that the transfer tape could be applied to a longer surface area of the elongated member 30 with more pulling force on the transfer tape.

This helps cause a sharper and cleaner adhesive tape breakage when the tape extending apparatus 210 lifts upward. The 3-way spool valves and roll contact switches were mounted on all the transfer tape application points when the tape extending apparatus 210 lifted upward. The 3-way spool valves and roll contact switches were mounted on all the taper devices on the exemplary Dynak machine. Different qualities of transfer tape were used including some tapes that had caused problems previously because of poor adhesive quality. Testing showed that the respooling apparatus 200 according to this invention was able to put on different qualities of transfer tape onto the adhesive transfer tape rolls with no problems of the transfer tape peeling back from the elongated member as the tape extending apparatus 210 retracts.

While this invention has been described in conjunction with specific embodiments thereof, it is evident that many alternatives, modifications and variations will be apparent to those skilled in the art. Accordingly, preferred embodiments in the invention as set forth herein are intended to be illustrative, not limiting. Various changes can be made without departing from the spirit and scope of the invention.

What is claimed is:

1. A method of applying adhesive transfer tape to an elongated member using an adhesive transfer tape apparatus comprising: an adhesive tape transfer roll holding an adhesive transfer tape; a timing device; a piston attached to the adhesive transfer tape roll that positions the transfer tape into and out of contact with the elongated member; a roll locking cylinder that engages and disengages the adhesive tape transfer roll to selectively stop rotation of the adhesive tape transfer roll when engaged and allow rotation of the adhesive tape transfer roll when disengaged; and a switch that communicates with both the piston and the roll locking cylinder to control operation according to output from the timing device, the method comprising:

moving the piston at a first timing to initially contact the transfer tape with the elongated member while the roll locking cylinder is disengaged to apply a first strip of adhesive tape to the elongated member;

controlling the switch at a second timing to engage the roll locking cylinder with the adhesive tape transfer roll to stop rotation of the transfer tape and at the same time control lifting of the transfer tape out of contact with the elongated member by retraction of the piston to break the first strip of adhesive tape;

controlling the switch at a third timing to disengage the roll locking cylinder from the adhesive tape transfer roll to allow rotation of the transfer tape and move the piston to push the transfer tape back into contact with the elongated member to apply a second strip of adhesive tape to the elongated member; and controlling the switch at a fourth timing to reengage the roll locking cylinder with the adhesive tape transfer roll to stop rotation of the transfer tape and at the same time moving the piston to lift the transfer tape out of contact with the elongated member to break the second strip of adhesive tape.

2. The method of claim 1, further comprising:

waiting a fifth timing after the fourth timing that allows release of internal stresses within the adhesive transfer roll to equalize before resetting the adhesive transfer roll to a start position to initiate a new taping sequence.

3. An apparatus for applying adhesive transfer tape to an elongated member, comprising:

an adhesive tape transfer roll holding an adhesive transfer tape;

a timing device;

a piston attached to the adhesive transfer tape roll that positions the transfer tape into and out of contact with the elongated member;

a roll locking cylinder that engages and disengages the adhesive tape transfer roll to selectively stop rotation of the adhesive tape transfer roll when engaged and allow rotation of the adhesive tape transfer roll when disengaged; and a switch that communicates with both the piston and the roll locking cylinder to control operation according to output from the timing device, wherein at a first timing the piston initially moves the transfer tape into contact with the elongated member while the roll locking cylinder is disengaged to apply a first strip of adhesive tape to the elongated member, at a second timing the switch controls the roll locking cylinder to engage the adhesive tape transfer roll to stop rotation of the transfer tape at the same time the piston lifts the transfer tape out of contact with the elongated member to break the first strip of adhesive tape, at a third timing the switch controls the roll locking cylinder to disengage the adhesive tape transfer roll to allow rotation of the transfer tape and the piston moves the transfer tape back into contact with the elongated member to apply a second strip of adhesive tape to the elongated member, at a fourth timing the switch controls the roll locking cylinder to engage the adhesive tape transfer roll to stop rotation of the transfer tape at the same time the piston lifts the transfer tape out of contact with the elongated member to break the second strip of adhesive tape.

4. The apparatus of claim 3, wherein the timing device provides a fifth timing at a time interval after the fourth timing that allows release of internal stresses within the adhesive transfer roll have equalized before the adhesive transfer roll is reset to a start position.

5. The apparatus of claim 3, wherein a cam track and cam form the timing device.

6. The apparatus of claim 3, wherein the switch communicates with the roll locking cylinder and the piston through air pressure transfer links and switching occurs through change in air pressure through the air pressure transfer links.

7. The apparatus of claim 6, wherein the switch is a 3-way spool valve.

* * * * *